US005699321A

United States Patent [19]

Vaucher

[11] Patent Number: 5,699,321

[45] Date of Patent: Dec. 16, 1997

[54] ANNUAL CALENDAR MECHANISM FOR A TIMEPIECE

[75] Inventor: Frank Vaucher, Cormoret, Switzerland

[73] Assignee: Compagnie Des Montres Longines, Francillon S.A., Saint-Imier, Switzerland

[21] Appl. No.: 679,715

[22] Filed: Jul. 12, 1996

[30] Foreign Application Priority Data

Jul. 28, 1995 [CH] Switzerland ..... 02 214/95

[51] Int. Cl.[6] ..... G04B 19/20

[52] U.S. Cl. ..... 368/37; 368/35; 368/28

[58] Field of Search ..... 368/28, 31–38

[56] References Cited

FOREIGN PATENT DOCUMENTS 1015546 10/1952 France .

449081 8/1927 Germany .

2311539 10/1973 Germany .

*Primary Examiner*—Bernard Roskoski

*Attorney, Agent, or Firm*—Sughrue,Mion,Zinn,Macpeak & Seas, PLLC

[57] ABSTRACT

A timepiece such as a watch carries a date ring with a window display. The ring carries an engaging system capable of driving at the end of each month an annual ring having twelve or twenty four external teeth and five internal teeth. A calendar driving wheel set has a first finger capable of driving the date ring and a second finger capable of driving the annual ring. At the end of a month of thirty days, one of the five internal teeth of the annual ring appears on the path of the second finger and drives this ring in its travel, such ring, from being driven becomes a driving wheel and, via the engaging system, causes the date ring to advance to the first of the following month. A manual correction remains necessary at the end of the month of February.

11 Claims, 6 Drawing Sheets

ANNUAL CALENDAR MECHANISM FOR A TIMEPIECE

The invention relates to an annual calendar mechanism for a timepiece, said mechanism comprising a date ring provided with thirty one internal teeth inside the ring, onto which are applied thirty one numbers each corresponding to a day of the month which appear successively through a window made in a dial, and a calendar driving wheel set making one rotation in twenty four hours, said wheel set having a first finger capable of driving the date ring through one step once each day via one of its internal teeth, said wheel set controlling the calendar display.

A calendar mechanism answering generally to the definition which has just been given is known for example from patent documents CH 538 136 and CH 661 171 (US 4,676,659). In these documents, there is also found a twenty four hour calendar driving wheel provided with a finger or a long tooth which drives a date disc bearing thirty one indications. However, the finger does not directly drive the disc but rather an intermediate wheel set which itself drives such disc. In this case, of course, it concerns an ordinary calendar mechanism, not an annual or perpetual calendar. At the end of months of thirty days and at the end of the month of February, it thus necessary to effect a manual correction should one not wish to lose the date.

A description of different types of calendar mechanisms in watches is given in the work entitled "Les montres calendrier modernes" by B. Humbert—Editions Scriptar S. A. Lausanne 1953 (English version: "Modern calendar watches", Lausanne 1954).

Patent document DE 2 311 539 discloses a calendar mechanism using a month cam making one rotation a year. Such cam has notches which are more or less deep: the full portions correspond to months of thirty one days; the shallow notches to months of thirty days; and a very deep notch to the month of February in the common years (twenty eight days). The beak of a lever urged by a spring acts on such cam. The depth of penetration of the beak will determine which advance must be imparted to the date indicator via a lever at the end of each month.

The mechanism briefly mentioned herein before uses levers and return springs, which lead to a relatively complicated construction which in turn necessitates a relatively high number of parts. On the other hand, it can be mentioned that such lever mechanisms do not always exhibit reliable operation, particularly if shocks are applied to the timepiece.

A perpetual calendar mechanism comprising relatively few parts is disclosed in patent DE 449 081. Several coaxial superposed discs, bearing respectively the indications of the days, the date from 1 to 15, the date from 15 to 31, the months and the years, have respective central apertures having toothings certain of which have variable teeth height. Such toothings are driven by two clicks carried by a movable part which pivots back and forth. One of the clicks has a flexible bent end which, by bearing against a toothing of variable height which acts as a cam, either drives or does not drive the second date disc in the last days of the month. The month disc carries a sliding spring which drives the first date disc to put it back into operation again when the month changes. Despite its apparent simplicity, this mechanism is thick, delicate and has not been widely used. Furthermore, it requires a reciprocating driving which necessitates an additional mechanism in a timepiece.

In order to obviate the cited drawbacks, the present invention proposes to use only gears to the exclusion of any levers or rocking bars, such gears, on the one hand, being prevented from making any untimely rotation, even if shocks are applied to the timepiece and, on the other hand, having a clearly simplified design and a reduced height, this being even more so the case since the calendar of the invention is limited to the automatic advance of the date for the months of thirty days only, the resetting of the date having to be effected manually at the end of the month of February. Hence, it concerns an annual and not a perpetual calendar.

An annual calendar in which a manual correction remains necessary at the end of the month of February has already been proposed and described in patent document CH 684 815. In this document, the annual calendar mechanism comprises a calendar driving wheel fitted with a finger capable of driving a date wheel through one step at the end of every day. An annual wheel, driven once a month through two steps by a long tooth carried by an intermediate wheel which itself engages with the date wheel, comprises a plate having five teeth each corresponding to one of the months of less than thirty one days. When one of these five teeth appears in the path of the finger, the annual wheel, from being driven itself, becomes a driving wheel and drives the date wheel through an additional step via the intermediate wheel.

Although having a clearly simplified design and a reduced height compared to a perpetual calendar, the mechanism which has just been described in summary hereinabove necessitates the provision of numerous new parts. It also necessitates a significant transformation of a basic movement which one would wish to modify as inexpensively as possible.

In order to overcome these drawbacks and thus to propose an annual calendar mechanism easily adaptable to a conventional movement, at the same time necessitating a minimum of new parts, the present invention is characterised in that, from the known features defined in the first paragraph of this description, the mechanism additionally comprises an annual ring superposed on the date ring, making one rotation in a year and fitted with external teeth in positions corresponding to the twelve months of the year and five internal teeth in positions corresponding to the months of less than thirty one days, said annual ring being arranged off-centre with regard to the date ring and next to the calendar driving wheel set so that it is actuated, at the end of months of less than thirty one days, by a second finger of the calendar driving wheel set, such second finger acting on one of the five internal teeth of the annual ring, engaging means fixed to the date ring being used to engage, at the end of each month, said date ring with said annual ring via at least one of said external teeth.

There results a mechanism whose movable parts are all rotatable and are only three in number, namely the driving wheel set, the date ring and the annual ring. These movable parts may be arranged on only two levels, that of the date ring and that of the annual ring passing above or below the latter. It is thus possible to realise the calendar mechanism in the form of a module of small thickness, which can be superposed on an ordinary watch movement. Furthermore, the off-centre arrangement of the annual ring offers, if such ring bears the month indications, great freedom of choice as to the position of the window where these indications appear, in particular at different distances from the centre of the clockwork movement and the dial. In particular, the annual ring may be arranged off-centre with regard to such centre and be large enough to pass around it, i.e. around the shafts of the hands of a conventional analogue display.

The invention will now be explained with the aid of the description which follows and the drawings which illustrate it by way of example, in which.

Figure 1:
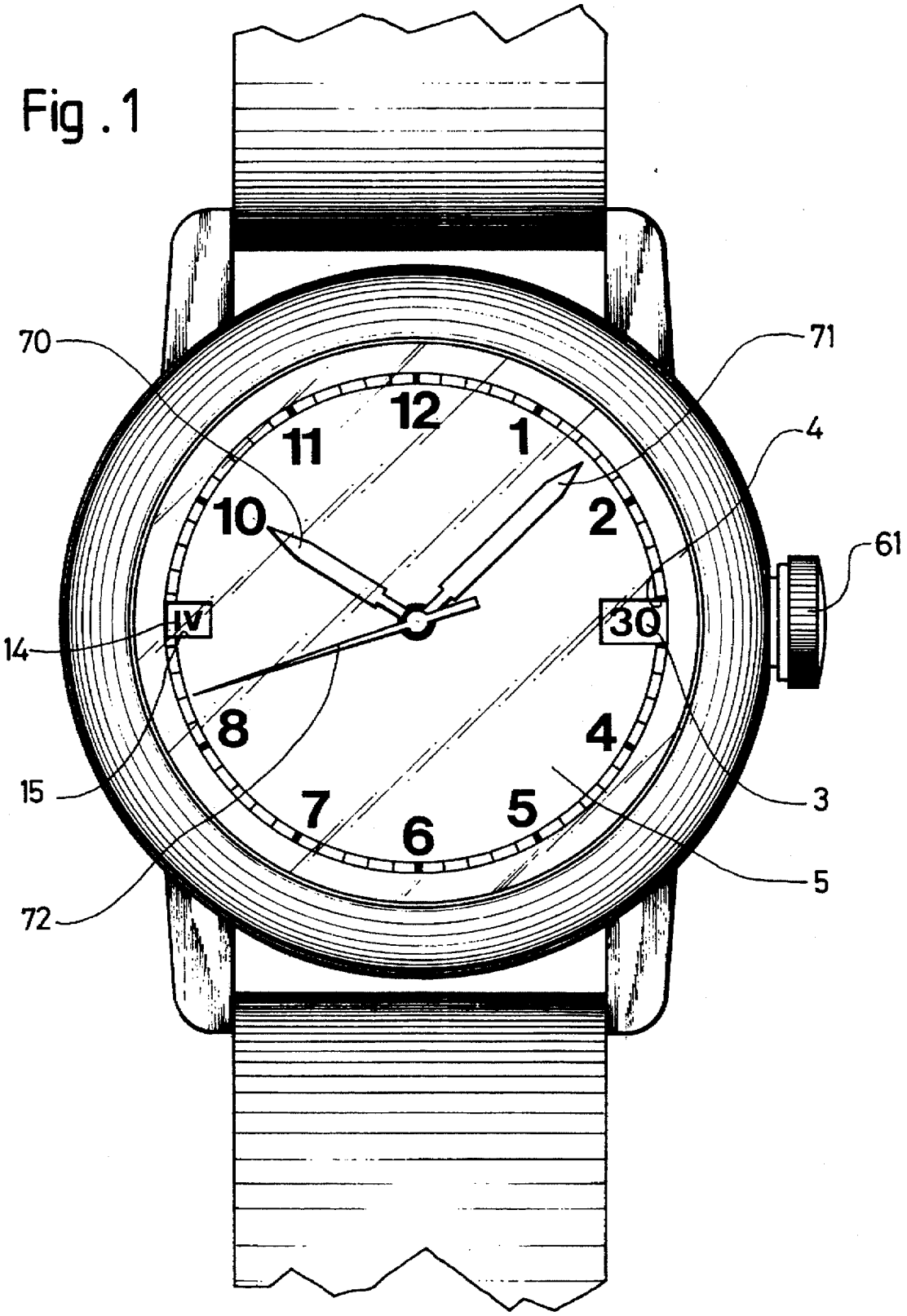
FIG. 1 is a top view of a watch having an annual calendar according to the invention.

The top view of FIG. 1 shows a watch fitted, apart from the hours hand 70, the minutes hand 71 and the seconds hand 72, with a date indicator in the form of a date 3 appearing through a window 4 made in a dial 5. Time setting may be effected by means of a control crown 61. If the dial is now removed from this watch and only the elements useful for realising the invention are kept, one ends up with the top views of FIGS. 2, 3 and 4 which show the mechanism in question at three different moments during the passing from the month of April to the month of May.

Figure 2:
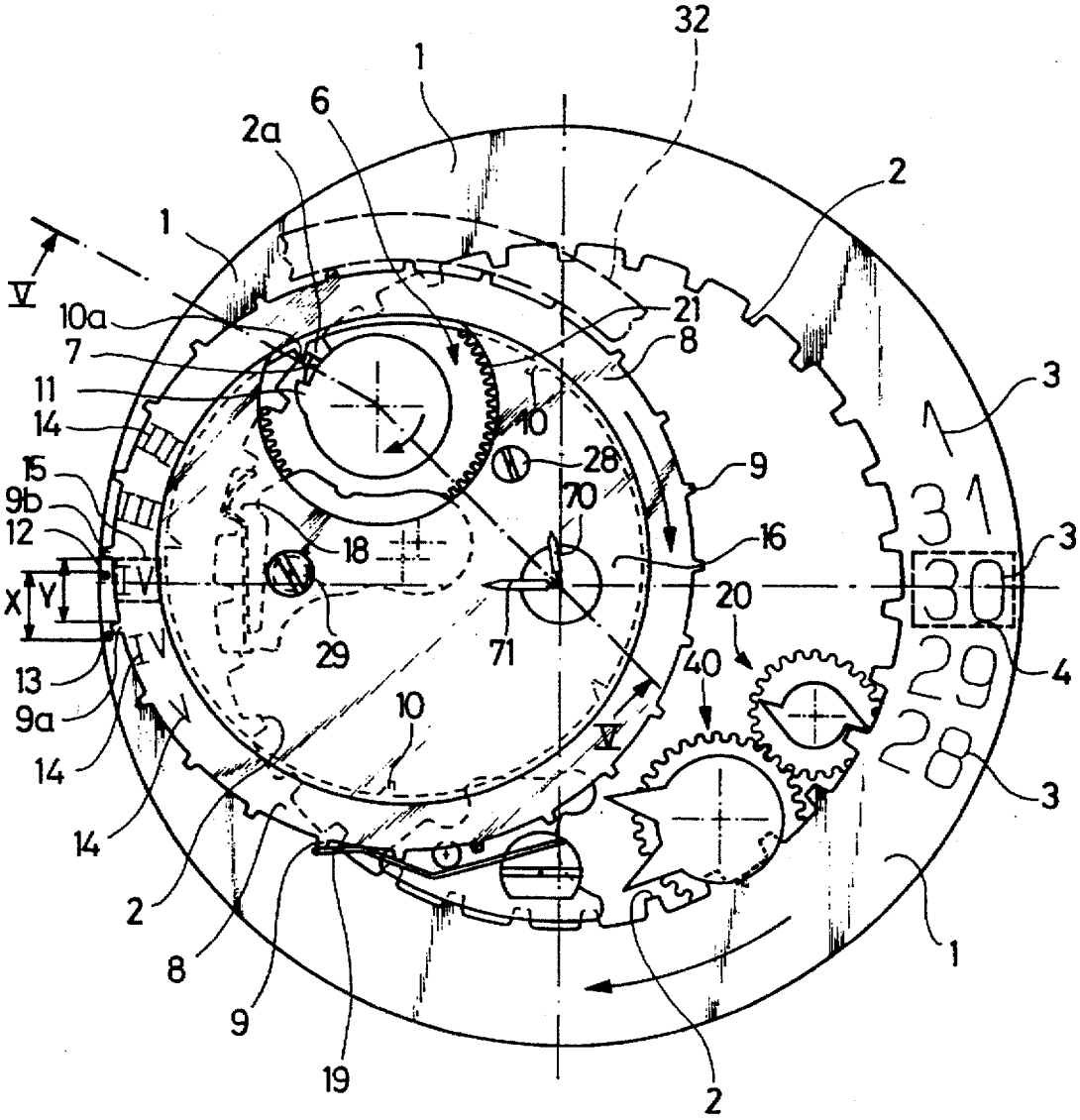
FIG. 2 is a top view of the annual calendar mechanism fitting the watch of FIG. 1, this figure illustrating the situation of wheels on 30 April at 23 hours and 45 minutes.
Figure 3:
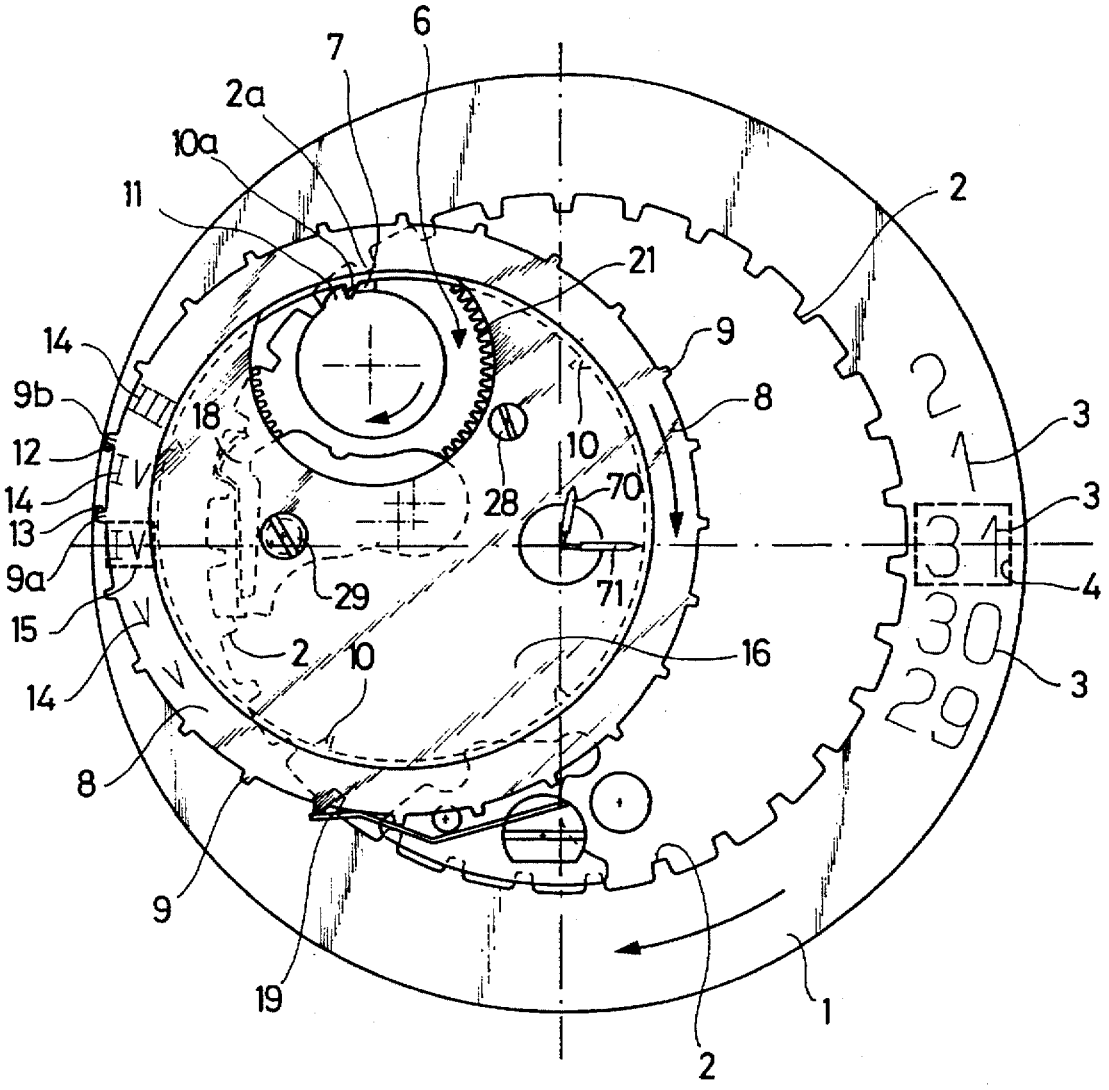
FIG. 3 is a similar view to that of FIG. 2, the situation of the wheels being that shown on 1st May at 0 hours and 15 minutes.
Figure 4:
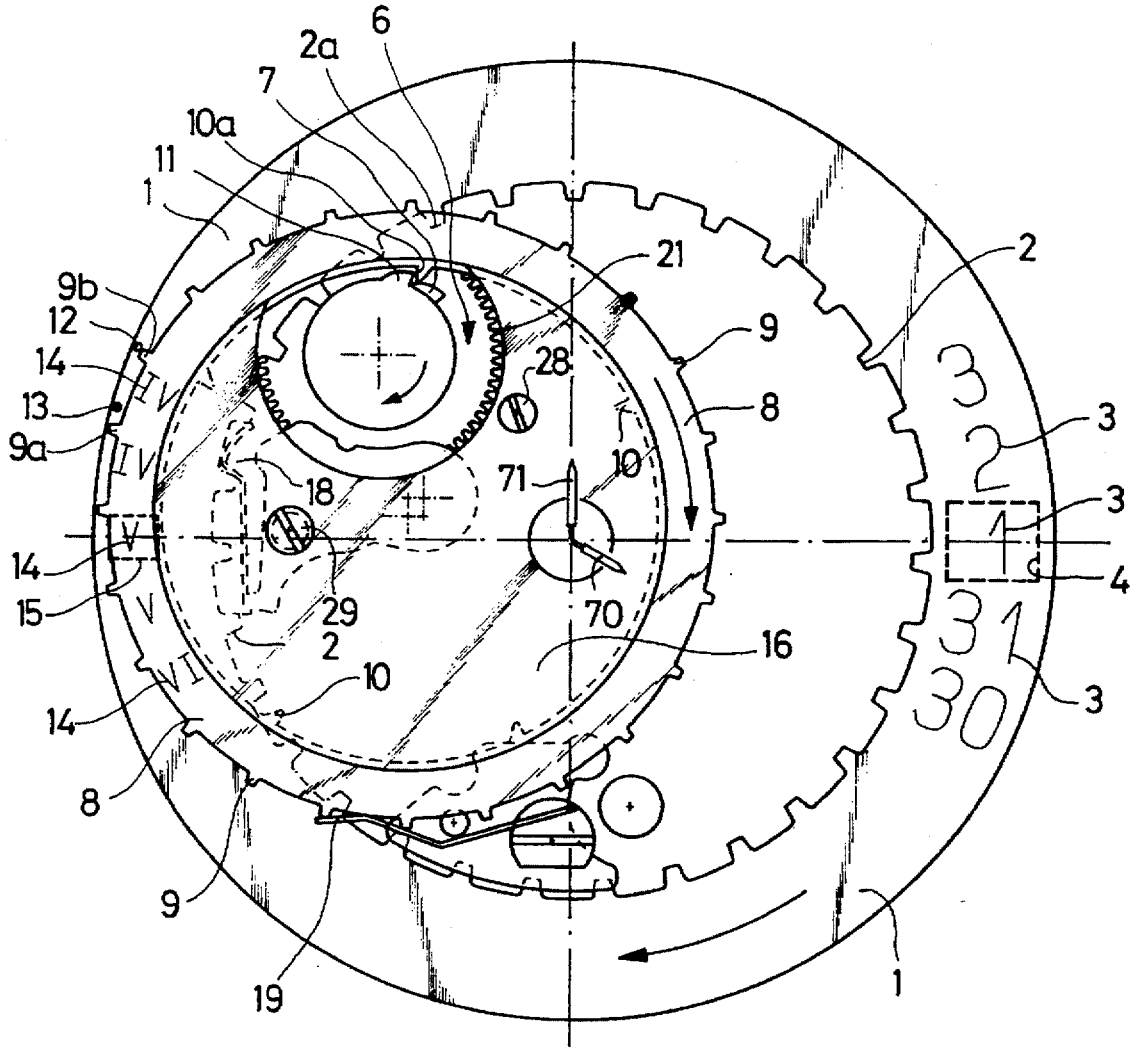
FIG. 4 is a similar view to that of FIG. 2, the situation of the wheels being that shown on 1st May at 4 hours.
Figure 5:
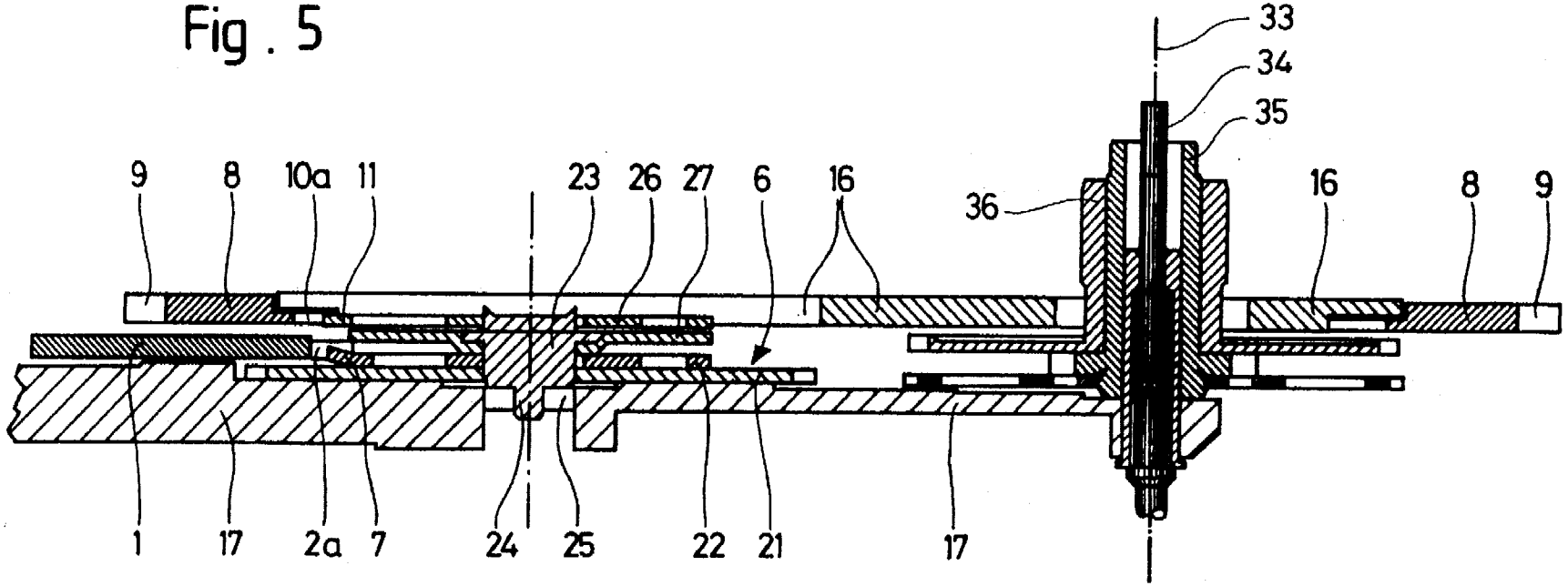
FIG. 5 is a cross-section along the line V—V of FIG. 2.

Examination of FIG. 2 and the cross-section of FIG. 5 in particular will help the annual calendar mechanism according to the invention to be understood. This mechanism comprises a date ring 1 fitted with thirty one teeth 2. Thirty one numbers 3 are applied onto ring 1 each corresponding to a day of the month. These numbers appear successively through window 4 made in dial 5 shown in FIG. 1. A calendar driving wheel set, globally designated by the reference 6, is fitted with a first finger 7 capable of driving date ring 1 through one step once a day via one of its internal teeth 2. In the particular case shown in FIG. 2, first finger 7 has just come into contact with tooth **2*a* and will thus cause ring 1 to advance through one step from 30 to 31 as is shown eventually in FIG. 3. As is seen in FIGS. 2 to 4 and better still in the cross-section of FIG. 5, driving wheel set 6 comprises a driving wheel 21 which connects this wheel set to the clockwork movement (not shown here) and makes one rotation in twenty four hours. The cross-section section of FIG. 5 shows that first finger 7 of driving wheel set 6 is situated in the path of tooth 2*a* belonging to date ring 1. Finger 7 is a protuberance of a disc 22 forced onto a shaft 23, driving wheel 21 being fixed to the same shaft 23. Via its pivot 24, shaft 23 can rotate freely in a bearing 25 mounted in the bottom plate 17** of the timepiece.

What has been described in the paragraph hereinabove is well known from the state of the art. It concerns the conventional driving of a date ring, such ring being able to be set to the date by a rapid date-corrector 20 (see FIG. 2) engaged with teeth 2 of ring 1, this date-corrector 20 being controlled by manual control crown 61 (FIG. 1). In such a conventional system, date setting is necessary at the end of the months which have less than thirty one days, namely the months of February, April, June, September and November.

One will now describe what has been added to this conventional mechanism to transform it, according to the invention, into a mechanism called an annual mechanism in the sense that the date jumps from 30 to 1st at the end of months of less than thirty one days.

In addition to what has been enumerated hereinabove, the mechanism according to the invention comprises an annual ring 8, as drawn in FIGS. 2 to 6. This annual ring is superposed on date ring 1 and makes one rotation in a year. Annual ring 8 is fitted with twenty four teeth 9 uniformly distributed on its external periphery, such external teeth 9 corresponding in pairs to the twelve months of the year, and with five teeth 10 on its internal periphery, such internal teeth 10 each corresponding to months of less than thirty one days. FIGS. 2 to 4 show that annual ring 8 is arranged off-centre with regard to date ring 1. It is also arranged in such a way that it is actuated at the end of the month having less than thirty one days, by a second finger 11 of calendar driving wheel set 6, this second finger 11 acting on one of said five internal teeth 10 of ring 8. In the particular case shown in FIG. 3, second finger 11 has just come into contact with tooth **10*a* of annual ring 8 and will cause said ring to advance through one step (one twenty fourth of a rotation or 15°) from IV to V as is shown in FIG. 4. As is clearly seen in the cross-section of FIG. 5, second finger 11 of wheel set 6 is a protuberance of a disc 26 forced onto shaft 23, disc 26 being mounted above disc 22 which has already been described and being separated from the latter by a spacer 27. The cross-section of FIG. 5 clearly shows that second finger 11 of driving wheel set 6 is situated on the path of tooth 10*a* belonging to annual ring 8. It will be noted however that finger 11 could be carried by the same disc 22 as finger 7, so that members 26 and 27** could be omitted.

FIGS. 2 to 4 show finally that engaging means 12, 13 fixed to date ring 1 are used for engaging or coupling, at the end of each month, said date ring 1 with said annual ring 8 via one of its twenty four external teeth 9.

The aforecited engaging means could consist of a single pin mounted at the periphery of date ring 1, or a cut and folded part of the edge of such ring, this pin or folded part engaging in twelve slits arranged on the periphery of the annual ring, such slits being separated by full parts acting as teeth. The use of two pins or catches 12 and 13 mounted perpendicularly on the periphery of ring 1 has, however, been preferred, such pins being arranged so that the circumferential length X (see FIG. 2) taken by the two pins is substantially equal to the empty space Y separating two successive external teeth **9*a* and 9*b* of annual ring 8. In any case, the respective diameters of ring 1 and ring 8 are selected so that at each change of month, ring 8 is driven through two twenty fourths of a rotation (30°) by date ring 1. Likewise, the internal diameter of ring 8 will be selected so that internal teeth 10 co-operate with second finger 11 also enabling the co-operation of first finger 7 with teeth 2 of date ring 1**.

FIGS. 2 to 5 also show that annual ring 8 pivots about a guide disc 16 fixed onto bottom plate 17 by means of two screws 28 and 29 (see FIGS. 2 to 4). The same figures also show that a first jumper spring 18 abuts between two successive teeth 2 of date ring 1 and that a second jumper spring 19 abuts between two successive external teeth 9 of annual ring 8. These jumper springs enable ring 1 and ring 8 to be angularly positioned at rest. It is because of jumper spring 19 that ring 8 comprises twenty four external teeth 9, to define its twenty four successive positions, whereas twelve teeth would be sufficient to co-operate with pins 12 and 13. It will be noted finally that twenty four indications 14, chosen here as roman numerals, are applied onto ring 8, arranged in pairs and identifying the months of the year, such indications appearing through a window 15 arranged in dial 5 as is shown in FIG. 1. In the figures, the date appears at 3 o'clock and the month at 9 o'clock. This display could appear in other places, for example the date at 12 o'clock and the month also at 12 o'clock but underneath.

FIG. 2 also shows that it is possible to provide a rapid month corrector 40 which preferably has two teeth engaging external teeth 9 of annual ring 8, to cause it to go back two steps per rotation of corrector 40. When control crown 61 is in a pulled out position, the rotation of the latter in a first direction actuates corrector 40, and in the other direction it actuates corrector 20. The principles of such correction mechanisms are known and do not need to be described here.

According to an alternative embodiment, guide disc 16 may be replaced by a fixed guide ring 32 (a fragment of which is shown in dash lines in FIG. 2) which surrounds and guides the periphery of annual ring 8, for example partially covering teeth 9. This alternative embodiment enables screws 28 and 29, situated inside the clockwork movement, to be replaced by screws or other fixing elements situated on the periphery of such movement and the calendar mechanism. This facilitates the application of the mechanism according to the invention in the form of a separate module which can be mounted without difficulty on different clockwork movements, having, in particular, different bottom plates.

It will be noted that with each of both guiding forms described hereinabove, off-centre annual ring 8 may be large enough to extend around the axis of rotation 33 (FIG. 5) of date ring 1, and thus also around the central shafts 34, 35 and 36 carrying the second, minute and hour hands in a conventional timepiece, as shown in the drawings. There result multiple possibilities for combining different relative positions of windows 4 and 15 where the date and the month respectively appear. Furthermore, annual ring 8 may be sufficiently wide to carry the names of the months in full or in abbreviated form. Finger 11 may be situated on a smaller radius than that of finger 10.

Another possibility for indicating the month consists in applying an index on annual ring 8, for example, a coloured index which is visible through a discontinuous circular slit or a circular row of apertures arranged in the dial above the annual ring, the names or numbers of the months being then marked on the dial. Since this display device is able to be arranged off-centre on the dial, it offers interesting possibilities of a decorative and aesthetic nature.

The different elements forming the invention and the manner in which they interact having been defined hereinabove, the operation of the annual calendar mechanism remains to be explained. Two cases may occur according to whether months of less than thirty one days or months of thirty one days are concerned.

The passing from 30th to the first day of the following month in the case of a month of less than thirty one days is illustrated in FIGS. 2, 3 and 4. FIG. 2 shows the mechanism as it appears on 30 April (a month of 30 days) when its hours hand 70 and minutes hand 71 indicate 23 hours and 45 minutes. At this moment the date displayed is 30 and the month displayed is the first indication IV (April). Pins 12 and 13 of ring 1 are almost engaged between teeth **9*a* and 9*b* of annual ring 8. Likewise, first finger 7 of driving wheel set 6 comes into contact with tooth 2*a* of ring 1. In FIG. 3, the same mechanism is seen when hours hand 70 and minutes hand 71 indicate 0 hours and 15 minutes on the 1st of May. First finger 7 of wheel set 6 has driven date ring 1 through one step, via tooth 2*a*, such ring then displaying the date 31 (momentarily). Annual ring 8 has been advanced through one step by pin 12 acting on tooth 9*b*, this ring displaying the second IV (momentarily). Second finger 11 of wheel set 6 comes into contact with tooth 10*a* of ring 8. In FIG. 4, the same mechanism is seen when hours hand 70 and minutes hand 71 indicate 4 hours and 0 minutes the 1st of May. Ring 8 has been driven through one step by second finger 11 of wheel set 6 and now displays the first indication V (May). Said ring 8, from being normally driven by ring 1, has become a driving wheel through the action of finger 11 and then drives, via its tooth 9*a*, date ring 1 via pin 13. Ring 1 displays, at the end of its travel, the FIG. 1. Once this phase has ended, pins 12 and 13 are disengaged from teeth 9*a* and 9*b* and ring 1** can continue its rotation day after day. In order not to mislead the wearer of the watch, one could replace the second indication of months of less than thirty one days (i.e. II, IV, VI, IX and XI) by a coloured point or an empty space.

The passing from the 31st to the 1st day of the following month in the case of a month of thirty one days is not illustrated in the figures. It will be understood that in such case none of the five teeth 10 of annual ring 8 is situated on the path of second finger 11 of wheel set 6. For example, annual ring 8 displays the month of May, namely the first figure V as illustrated in FIG. 4. At midnight on the 30th May, the date ring jumps to 31 (through the action of first finger 7) and causes annual ring 8 to advance through one step, such ring then displaying the second V (through the effect of pin 12). At midnight on the 31st May, the date ring jumps to the 1st June under the effect of finger 7 and thus causes annual ring 8 to advance through a new step, ring 8 then displaying the first VI (June) through the effect of pin 12.

Figure 6:
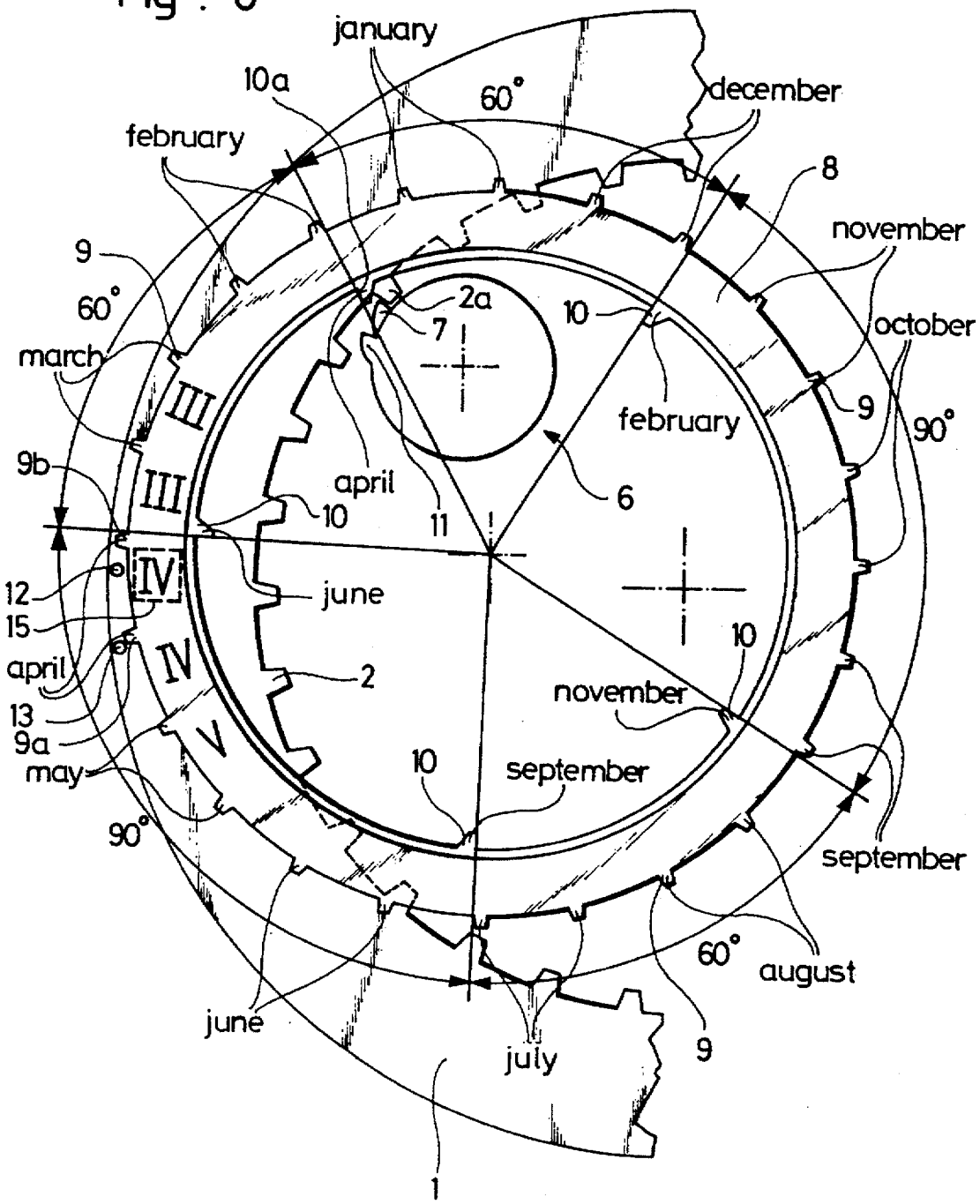
FIG. 6 is a top view of the annual crown wheel of FIG. 2 which explains the function of such crown wheel with regard to the months of the year.

FIG. 6 is a partial resumption of FIG. 2. It shows annual ring 8 in its entirety and date ring 1 and driving wheel set 6 partially. It can be seen that internal teeth 10 of ring 8 are arranged around the internal periphery of said ring successively at 60°, 60°, 90°, 60° and 90°. If these teeth 10, which represent the months of February, April, June, September and November, are situated on the path of second finger 11 of wheel set 6, the date will pass rapidly, at the end of these months, from 30 to 31, then from 31 to the 1st of the following month, as has been explained hereinabove.

If the system which has just been described pursues the same aim as that exposed in the aforecited patent document CH 684 815, it has, compared to this publication of the prior art, notable simplifications in the reduced number of parts which it uses and in the minimum space requirements which it proposes. Indeed, the only significant new parts are annual ring 8 and second driving finger 11. This system thus sees the timepiece thicken only by the thickness of this annual ring. Furthermore, conventional movements fitted with a single date ring are very easily adapted to this new calendar.

What is claimed is:

1. An annual calendar mechanism for a timepiece, said mechanism comprising a date ring fitted with thirty one internal teeth inside the ring, onto which are applied thirty one numbers each corresponding to a day of the month which are displayed successively through a window made in a dial, and a calendar driving wheel set making one rotation in twenty four hours, said wheel set having a first finger capable of driving said date ring through one step once a day via one of its internal teeth for changing the displayed number, wherein said mechanism further comprises an annual ring partially superposed on said date ring, said annual ring making one rotation in a year and having external teeth in positions corresponding to the twelve months of the year and five internal teeth in positions corresponding to the months of less than thirty one days, said annual ring being arranged off-centre with regard to said date ring and next to said calendar driving wheel set so that it is actuated, at the end of months of less than thirty one days, by a second finger of said calendar driving wheel set, said second finger acting on one of said five internal teeth of the annual ring, said date ring having engaging means for engaging at least one of said external teeth of said annual ring at the end of each month.

2. A mechanism according to claim 1, wherein said engaging means comprise two pins or catches mounted perpendicularly on the periphery of said date ring, a circumferential length taken by said two pins being arranged so that said pins can engage, at the end of each month, in an empty space separating two successive external teeth of said annual ring.

3. A mechanism according to claim 1, wherein indications identifying the months of the year are applied onto said annual ring, said indications appearing successively through a second window made in said dial.

4. A mechanism according to claim 3, wherein said external teeth of said annual ring are twenty four in number and co-operate with a jumper spring defining twenty four angular positions of said annual ring.

5. A mechanism according to claim 4, wherein at least those of said indications which identify the months of thirty one days are applied twice onto said annual ring, to appear in said second window in two successive positions of said annual ring.

6. A mechanism according to claim 1, wherein said annual ring is mounted around a fixed guide disc.

7. A mechanism according to claim 1, wherein said annual ring is mounted inside a fixed guide ring.

8. A mechanism according to claim 1 wherein said annual ring extends off-centre about an axis of rotation of the date ring.

9. A mechanism according to claim 1, comprising a rapid date corrector, engaged with said internal teeth of said date ring, said corrector being actuated by a control crown of the timepiece.

10. A mechanism according to claim 9, comprising a rapid month corrector, engaged with said external teeth of said annual ring, said corrector being actuated by said control crown.

11. A mechanism according to claim 1, wherein said five internal teeth of said annual ring are arranged around the inside of said annual ring at successive angular intervals of 60°, 60°, 90°, 60° and 90°.

* * * * *